US009723389B2

(12) United States Patent
Zhang

(10) Patent No.: US 9,723,389 B2
(45) Date of Patent: Aug. 1, 2017

(54) SPEAKER

(71) Applicant: Yang Zhang, Shenzhen (CN)

(72) Inventor: Yang Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/011,014

(22) Filed: Jan. 29, 2016

(65) Prior Publication Data

US 2017/0013340 A1 Jan. 12, 2017

(30) Foreign Application Priority Data

Jul. 9, 2015 (CN) ..... 2015 2 0518128 U

(51) Int. Cl.

| | |
|---|---|
| ***H04R 9/00*** | (2006.01) |
| ***H04R 1/06*** | (2006.01) |
| *H04R 9/06* | (2006.01) |
| *H04R 31/00* | (2006.01) |

(52) U.S. Cl.

CPC ..... *H04R 1/06* (2013.01); *H04R 9/06* (2013.01); *H04R 31/003* (2013.01); *H04R 2231/003* (2013.01); *H04R 2307/204* (2013.01)

(58) Field of Classification Search

CPC .... H04R 9/00; H04R 29/003; H04R 2209/00; H04R 2209/41; H04R 7/04

USPC ..... 381/409, 431, 423–424

See application file for complete search history.

(56) References Cited

U.S. PATENT DOCUMENTS

| | | | | |
|---|---|---|---|---|
| 7,864,977 | B2 * | 1/2011 | Sadaie | H04R 1/227 381/431 |
| 8,311,264 | B2 * | 11/2012 | Lee | H04R 9/022 381/431 |
| 8,705,788 | B2 * | 4/2014 | Xu | H04R 31/006 381/409 |
| 8,938,086 | B2 * | 1/2015 | Zhang | H04R 9/025 381/409 |
| 8,953,834 | B2 * | 2/2015 | Kim | H04R 9/047 381/431 |

* cited by examiner

*Primary Examiner* — Suhan Ni
(74) *Attorney, Agent, or Firm* — Na Xu; IPro, PLLC

(57) ABSTRACT

A speaker is provided in the present disclosure. The speaker includes a membrane, a voice coil connected to the membrane, and a solder pad formed on the membrane. The membrane includes a conductive silicone portion and a non-conductive silicone portion. The voice coil includes a coil portion for driving the membrane to vibrate, and a line lead portion led out from an end of the coil portion. The line led portion is connected to the solder pad, and the solder pad is formed on the conductive silicone portion of the membrane. The conductive silicone portion is connected to an input terminal of the speaker to receive an electric signal for driving the voice coil.

7 Claims, 3 Drawing Sheets

SPEAKER

FIELD OF THE DISCLOSURE

The present disclosure relates to electro-acoustic transducer technologies, and more particularly, to a speaker applicable to a mobile device for producing audible sound.

BACKGROUND

Speakers are widely applied in mobile devices, such as mobile phones, tablet computers or laptop computers, for converting electrical signals into audible sounds.

A typical speaker includes a membrane and a voice coil connected with the membrane; the voice coil is used to drive the membrane to perform vibration and produce sounds. Generally, the voice coil utilizes a lead wire to receive electric signal, and the lead wire is generally fixed to a holder of the speaker.

However, the lead wire of the voice coil may suffer flexure vibration when the voice coil drives the membrane to vibrate. The flexure vibration of the lead wire needs to occupy an extra space in the speaker, which is not good for miniaturization of the speaker. Moreover, the lead wire is liable to collide with the holder or the membrane during flexure vibration; this may deteriorate a sound quality of the speaker. In addition, the lead wire may also be overstretched and broken off when the flexure vibration is too fierce; therefore, reliability of the speaker is low.

Therefore, it is desired to provide a new speaker which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiments thereof.

Figure 1:
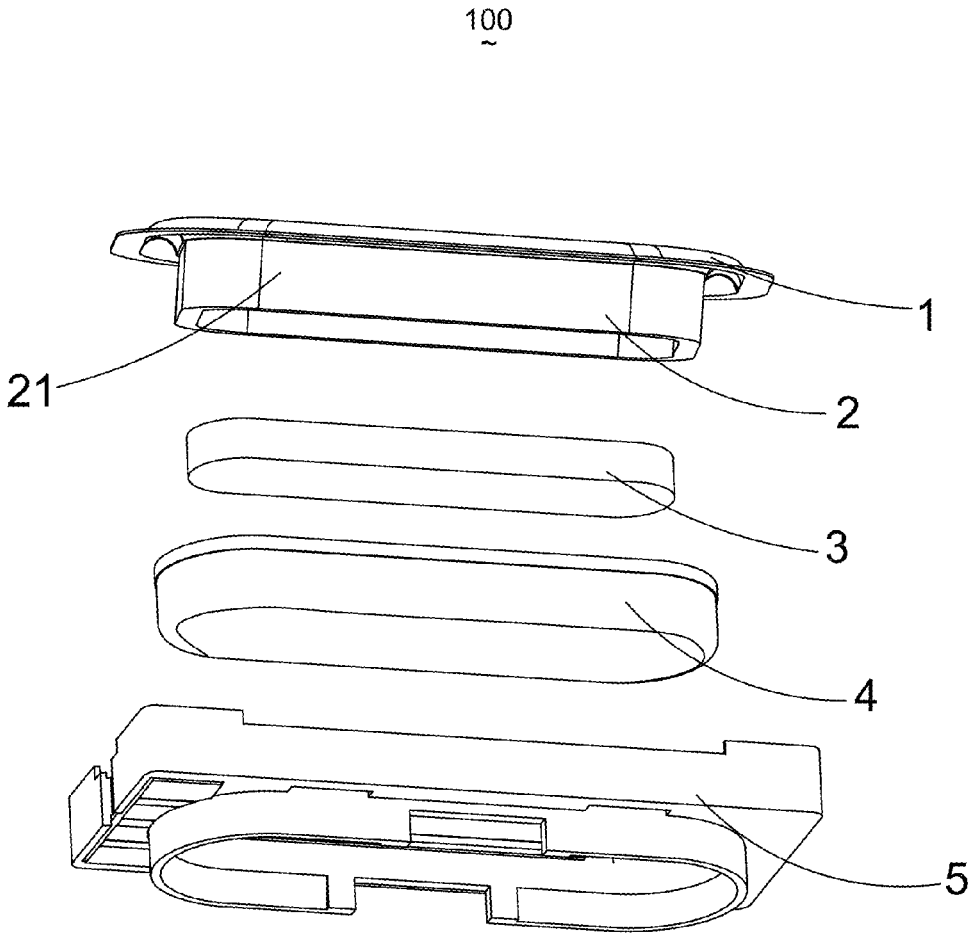
FIG. 1 is an exploded view of a speaker according to a first embodiment of the present disclosure.
Figure 2:
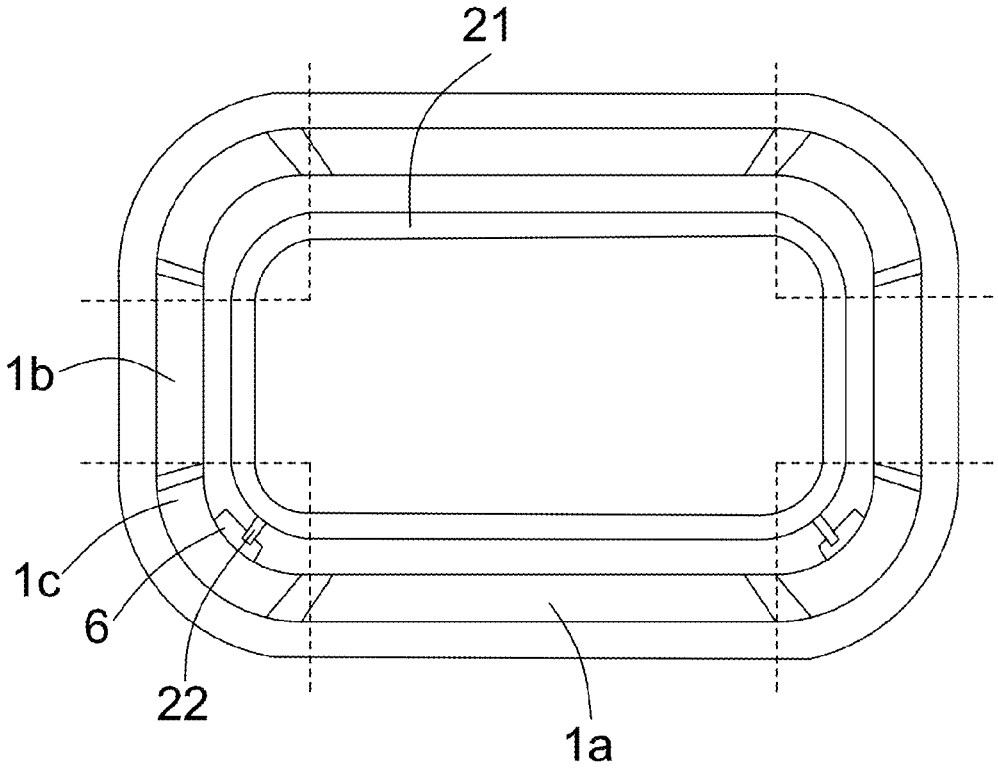
FIG. 2 is a planar, assembled view of the speaker of FIG. 1.

Referring to FIGS. 1-2, a speaker 100 according to a first embodiment of the present disclosure is shown. The speaker 100 may be a micro speaker applicable to a mobile device such as a mobile phone, a personal digital assistant, a tablet computer, a laptop computer, or the like. The speaker 100 includes a holder 5, a yoke 4 received in the holder 5, a magnet 3 received in the yoke 4, a voice coil 2 and a membrane 1.

The voice coil 2 is connected with the membrane 1, and includes a coil portion 21 and a line lead portion 22. The coil portion 21 is configured for driving the membrane 1 to vibrate and produce audible sounds. The line lead portion 22 is led out from an end of the coil portion 21.

The membrane 1 includes a pair of opposite long edges 1*a*, a pair of opposite short edges 1*b*, and four curved edges 1*c*, as schematically separated in FIG. 2 by dashed lines. The four curved edges 1*c* are arranged at four corners of the membrane 1, and the long edges 1*a* and the short edges 1*b* are connected end to end by four curved edges 1*c* respectively to form a ring-shaped periphery.

The membrane 1 may be a silicone diaphragm, which can be separated into a conductive silicone portion and a non-conductive silicone portion. In the present embodiment, the conductive silicone portion of the membrane 1 includes one or more curved edges 1*c*, and the non-conductive silicone portion includes the long edges 1*a* and the short edges 1*b*.

Optionally, the conductive silicone portion and the non-conductive silicone portion of the membrane 1 may be formed by a same integrated injection molding process, that is, the conductive silicone portion and the non-conductive silicone portion are formed simultaneously. Alternatively, the conductive silicone portion and the non-conductive silicone portion of the membrane 1 may be formed by two independent injection molding processes respectively; for example, one of the conductive silicone portion and the non-conductive silicone portion is firstly formed by a first injection molding process, and then the other one of the conductive silicone portion and the non-conductive silicone portion is formed by a second injection molding process.

Moreover, the speaker 100 further includes a solder pad 6. The solder pad 6 is formed on the conductive silicone portion of the membrane 1, for example, in the present embodiment as illustrated in FIG. 2, the solder pad 6 is formed on one of the curved edges 1*c* of the membrane 1. The line lead portion 22 of the voice coil 2 is drawn out from the coil portion 21 at a corresponding corner of the voice coil 2 adjacent to the solder pad 6, and an end of the line lead portion 22 is electrically connected and fixed onto the solder pad 6. Moreover, the conductive silicone portion of the membrane 1 is further connected to an input terminal of the speaker 100 to receive an electric signal for driving the voice coil 2. In the present embodiment, the solder pad 6 may be integrated onto the corresponding curved edge 1*c* of the membrane 1 by an injection process or a hot pressing process.

Figure 3:
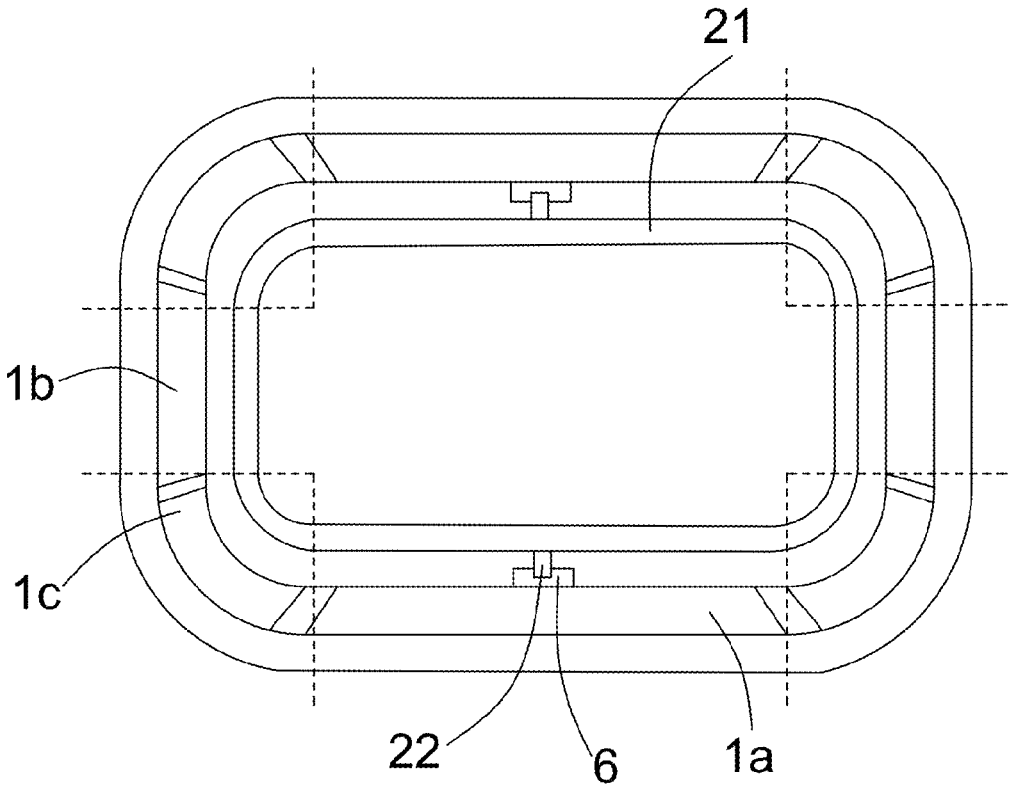
FIG. 3 is a planar, assembled view of a speaker of according to a second embodiment of the present disclosure.

Referring to FIG. 3, in a second embodiment, the conductive silicone portion of the membrane 1 includes at least one of the long edges 1*a*, and the non-conductive silicone portion of the membrane 1 includes the short edges and the curved edges 1*c*. Correspondingly, the solder pad 6 is formed on the at least one of the long edges 1*a* of the membrane 1; for example, the solder pad 6 may be integrated onto the corresponding long edge 1*a* of the membrane 1 by an injection process or a hot pressing process.

It should be noted that the conductive silicone portion can be configured at other parts of the membrane 1 in other embodiments. For example, the conductive silicone portion may alternatively include at least one of the short edge 1*b*, and the solder pad 6 is formed on the at least one of the short edges 1*b* of the membrane 1. Furthermore, the conductive silicone portion may also be configured at one or more of the long edges 1*a*, the short edges 1*b* and the curved edges 1*c*; in particular, a main body of the membrane 1 (including the long edges 1*a*, the short edges 1*b* and the curved edges 1*c*) can be configured as the conductive silicone portion, except for a gap formed by non-conductive silicone to provide electrical insulation.

In the speaker 100 as provided in the present disclosure, the line lead portion 22 of the voice coil 2 is fixed onto the solder pad 6 formed on the membrane 1, with this configuration, when the voice coil 2 drives the membrane 1 to vibrate, the line lead portion 22 would not perform any flexure vibration, this can not only save an internal space of the speaker 100 and enhance miniaturization of the speaker 100, but also protect the line lead portion 22 from colliding with the holder 5 or the membrane 1 as well as from being over-stretched. Therefore, both the sound quality and the reliability of the speaker 100 can be improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a holder;

a yoke received in the holder and a magnet received in the yoke;

a membrane comprising a conductive silicone portion and a non-conductive silicone portion;

a voice coil connected to the membrane; and a solder pad integrated with the conductive silicone portion of the membrane by an injection process or a hot pressing process;

wherein the voice coil comprises a coil portion for driving the membrane to vibrate, and a line lead portion lead out from an end of the coil portion, the line lead portion is connected to the solder pad;

the membrane has two opposite long edges, two opposite short edges, and four curved edges, the four curved edges are arranged at four corners of the membrane;

the long edges and the short edges are connected end to end by four curved edges, respectively;

and the conductive silicone portion is connected with an input terminal of the speaker for receiving an electric signal for driving the voice coil.

2. The speaker of claim 1, wherein at least one of the curved edges of the membrane is configured as the conductive silicone portion, the solder pad is arranged on the curved edge configured as the conductive silicone portion, and the long edges and the short edges are configured as the non-conductive silicone portion.

3. The speaker of claim 1, wherein at least one of the long edges or the short edges of the membrane is configured as the conductive silicone portion; the solder pad is arranged on the long edge or the short edge configured as the conductive silicone portion, the curved edges are configured as the non-conductive silicone portion.

4. The speaker of claim 1, wherein the conductive silicone portion and the non-conductive silicone portion of the membrane are formed by a same integrated injection molding process.

5. The speaker of claim 1, wherein the conductive silicone portion and the non-conductive silicone portion of the membrane are formed by two independent injection molding processes respectively.

6. The speaker of claim 1, wherein the conductive silicone portion is configured at one or more of the long edges, the short edges and the curved edges.

7. The speaker of claim 6, wherein a main body of the membrane serves as the conductive silicone portion, and a gap formed at the main body by non-conductive silicone serves as the non-conductive silicone portion to provide electrical insulation.

* * * * *